US005447681A

United States Patent [19]

Tai Seung et al.

[11] Patent Number: 5,447,681

[45] Date of Patent: Sep. 5, 1995

[54] METHOD FOR MANUFACTURING METAL GRAPHITE BRUSH

[75] Inventors: Chung Tai Seung; Kim Seong Soo, both of Seoul; Lee Jae Sung, Ansan City, all of Rep. of Korea

[73] Assignee: Mando Corporation, Kyungki-Do, Rep. of Korea

[21] Appl. No.: 173,660

[22] Filed: Dec. 27, 1993

[51] Int. Cl.[6] ..... B22F 3/12

[52] U.S. Cl. ..... 419/36; 419/5; 419/6; 419/10; 419/11; 419/12; 419/23; 419/17; 419/38; 419/39; 310/DIG. 2

[58] Field of Search ..... 419/5, 6, 10, 11, 12, 419/23, 17, 36, 38, 39; 423/445; 252/503; 310/219; 51/295; 75/200, 243

[56] References Cited

U.S. PATENT DOCUMENTS

| | | | |
|---|---|---|---|
| Re. 32,319 | 12/1986 | Korb et al. | 423/445 |
| 3,601,645 | 8/1971 | Whiteheart | 310/219 |
| 3,631,683 | 1/1972 | Yoshikawa | 51/295 |
| 4,131,460 | 12/1978 | Orford | 419/17 |
| 4,358,319 | 11/1982 | Yoshida et al. | 75/200 |
| 4,550,015 | 10/1985 | Korb et al. | 423/445 |
| 4,642,201 | 2/1987 | Vogel | 252/503 |
| 4,799,957 | 1/1989 | Vogel | 75/243 |

*Primary Examiner*—Donald P. Walsh
*Assistant Examiner*—John N. Greaves
*Attorney, Agent, or Firm*—Hughes, Multer & Schacht

[57] ABSTRACT

A method for manufacturing a metal graphite brush comprises steps of preparing natural graphite powders of 60–70 wt %, electrolytic copper powders of 30–40 wt %, molybdenum disulfide and lead of 2.5 wt % and the mixed resin of novolak phenol resin and furfural resin powders of 1–15 wt % which are adhesives, wet-mixing graphite powders with adhesives, pulverizing mixed powders to diameters of less than 200 μm, press-molding all the powders under a pressure of 2–3 ton/cm$^2$ and heating at a temperature 700° C., and attaching a lead wire thereto, simultaneously, wherein the average particle distribution of the powders is 27 μm. The compound ratio of graphite powders: copper powders: molybdenum disulfide: lead is 62.5 wt %: 35 wt %: 1.5 wt %: 1.0 wt %, the adhesives comprising the mixed resin of novolak phenol resin and furfural resin by 50:50 is added by a weight ratio of 7.5 wt % to the graphite powders.

7 Claims, 1 Drawing Sheet

METHOD FOR MANUFACTURING METAL GRAPHITE BRUSH

BACKGROUND OF THE INVENTION

1. Field of the Invention

The present invention relates to a method for manufacturing a metal graphite brush. More particularly, this invention relates to a method for manufacturing a metal graphite brush in which the amount of the graphite powder adhesives is adjusted in order to reduce the friction coefficient as well as to enhance the bonding strength of the metal graphite, which comprises the compounds of the brush.

2. Description of the Prior Art

A conventional typical method for manufacturing a graphite brush is disclosed in Japanese Laid-Open Patent Publication No. 90-51345. This patent concerns a method for preventing an excessive skin film on a commutator surface from being excessively formed as well as for reducing the abrasion on the brush during high speed rotations of large capacity, thereby prolonging the useful life-span of the brush. That is, the brush is manufactured with a mixture of powders of a aluminum abrasive, molybdenum disulfide($MoS_2$) and tungsten disulfide ($WS_2$), each powder consisting of particles having diameters of less than 50 μm, said powders combined in a solution of adhesives, prepared with grains of 70–300 μm, artificial graphite powders 70 wt % mixed with adhesives of novolak phenol resin and methanol, pulverized and prepared with powders having a diameter 100 μm, the compound of abrasives+lubricant+adhesives of 0.5–15 wt % to graphite powder compressed at a pressure of 0.25 t/cm$^2$ and fired at a temperature of 700° C.

On the other hand, a general method for manufacturing a metal graphite brush for use in a small motor for a small automobile is different due to the addition of various metal contents according to the desired power output characteristic and motor durability. If high power output is desired, a metal content of 60–90 wt % is added. If high durability is desired, a metal content of 10–50 wt % is added. In addition, the graphite must be natural graphite in order to enhance the lubrication property. Furthermore, in order to improve the durability and the high power output of the brush and the noise reduction characteristics of the motor, control of the bonding strength and porosity is achieved by adjusting the amount and type of resins such as novolak phenol resins, resol type phenol resins and bisphenol A type epoxy resins, also called adhesives.

However, in manufacturing a metal graphite brush based on a conventional method, in which the metal contents are increased in order to improve the power output characteristics the specific resistance of the brush is reduced but a negative consequence is on the anti-abrasion of the brush and the noise reduction characteristic of the motor.

Further, after firing the brush, the addition of more adhesives for the purpose of improving the bonding strength achieves the predetermined bonding strength, but it causes the brush to become more dense as well as to become less porosity, so that the friction coefficient efficiency of the brush is increased which in turn generates a greater amount of noise in the motor. If the addition of different adhesives is desired in order to strengthen the bonding property, there are difficulties in that the differences in the carbon contents are dependent upon the kind of adhesives which restrict the smooth performance of the power supply function of the brush adapted to the commutator due to the porosity and the skin film of the commutator graphite and lubricants. Furthermore it has problems in that the adjustment of the amount of carbon, that is, hard carbon, to be contained in the adhesives removes the skin film and acts as an abrasive.

In order to resolve these problems and difficulties, methods have been used in a manner whereby the metal contents were relatively smaller to reduce the friction coefficient, natural graphite was used to reduce the fluctuations in the contact voltage, molybdenum disulfide is used as a lubricant to enhance the anti-abrasion, and one or two adhesives of phenol resin etc. are used to increase the bonding strength.

SUMMARY OF THE INVENTION

It is accordingly an object of the present invention to provide a method for manufacturing a metal graphite brush for reducing the friction coefficient, which is an important factor in a noise reduction characteristic, and the specific resistance, which is a major factor in the power output characteristics.

An other object of the present invention is to provide a method for manufacturing a metal graphite brush for adjusting the amount of graphite in adhesives so as to strengthen the bonding strength of the metal graphite and to reduce the friction coefficient, thereby enhancing the noise reduction characteristics.

Another object of the present invention is to provide a method for manufacturing a metal graphite brush comprising the compound of additives containing 1.5 wt % molybdenum disulfide ($MoS_2$) and 1 wt % lead and adhesives of 7.5 wt % including a novolak phenol resin and furfural resin at a 50 to 50 ratio, thereby increasing the strength of the product.

In order to achieve these objects and features, a method for manufacturing a metal graphite brush according to the present invention comprises the steps of: preparing powders of natural graphite of 60–70 wt %, electrolytic coppers of 30–40 wt %, molybdenum disulfide and lead of 2.5 wt %, which are additives, and novolak phenol resin and furfural resin of 1–15 wt %, which are adhesives; wet-mixing the mixed resins with the graphite powders and preparing powder mixes having diameters of less than 200 μm; press-molding said powders under a pressure of 2–3 ton/cm$^2$, firing the mix at a temperature of 600°–800° C. and simultaneously attaching a lead wire thereto.

Herein, the particle size distribution of copper powders is an average of 27 μm. The composition ratio of the mixed powders is: graphite of 62.5 wt %, copper powders of 35 wt %, additives of 2.5 wt %. The adhesives are produced with a mixture ratio of novolak phenol resin and furfural resin of 50:50, which is added by 7.5 wt % to graphite.

In particular, the present invention is characterized in that the novolak phenol resin and furfural resin mix at the ratio of 50:50 is preferably contained in the metal graphite brush by a weight ratio of 1–15 wt %, which is adhesives.

BRIEF DESCRIPTION OF THE DRAWINGS

The present invention will now be described in detail with reference to the accompanying drawings, wherein.

DETAILED DESCRIPTION OF THE INVENTION

Figure 1:
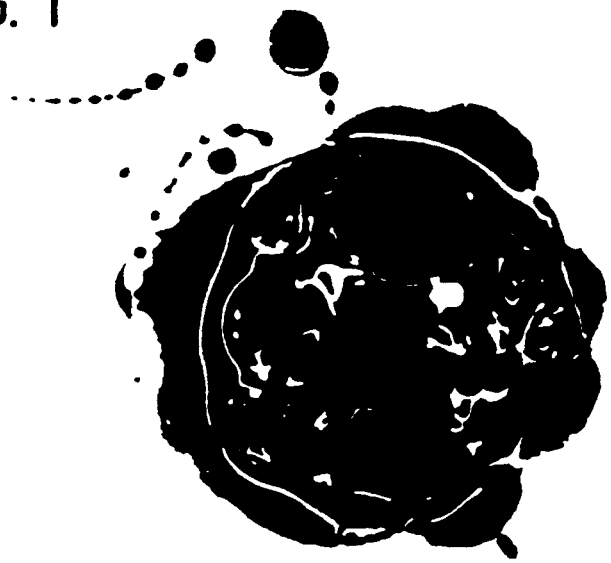
FIG. 1 is a photograph showing the wetability of a novolak phenol resin according to the present invention; and, FIG. 2 is a photograph showing the uniform wetability after firing the novolak phenol resin and furfural resin mix at the ratio of 50:50.

The present invention is manufactured as described in the following embodiment.

Adhesives are prepared with the novolak phenol resin and furfural resin mix at the ratio of 50:50 and then added at the weight ratio of 7.5 wt % to graphite powders for the wetmixing. The mixed graphite is dried and then pulverized to form graphite powders having diameters less than 200 μm.

The graphite powders containing the resin are blended with electrolytic copper powders, the average diameter of which is 27 μm, and molybdenum disulfide and lead powders each with an average diameter which is below 27 μm. In other words, the mixture is comprised of graphite powders of 62.5 wt %, copper powders of 35 wt %, molybdenum disulfide powders of 1.5 wt % and lead powders of 1.0 wt %. The mixture is press-molded at a pressure of 2.75 ton/cm$^2$ and heated to the temperature of 700° C., while a lead wire is attached to the mixture body. Therefore, the metal graphite is completed as a brush by being processed to be adapted to a motor.

That is, the method for manufacturing the metal graphite brush according to the present invention will be described in detail as follows:

Natural graphite powders of 60–70 wt %, electrolytic copper powders of 30–40 wt %, molybdenum disulfide and lead powders of 2.5 wt % to improve the lubrication property are prepared. These prepared powders are wet-mixed with adhesives of 1–15 wt % to graphite powders. Then, these powders are dried and pulverized so that the particle distribution is less than 200 μm.

Herein, it is noted that natural graphite is better than artificial graphite its the lubrication property, thereby enhancing the sliding function. The particle size distributions of graphite powders include −150 μm∼+63 μm:35 wt %, −63 μm∼+45 μm:30 wt % and −45 μm:35 wt %. Adhesives utilize the mixed resin of novolak phenol resin and furfural resin. The mixing ratio of these resins is desirably 25:75, more preferably 50:50 in respect of its total weight in order to obtain the superior combined effect of graphite and the resins. The mixed resin are added at the weight ratio of 7.5 wt % to graphite powders, wet-mixed, dried and pulverized to be a diameter less than 200 μm.

Graphite powders containing mixed resin are mixed with electrolytic copper powders having an average diameter of 27 μm, which are metal powders, and pulverized powders of molybdenum disulfide and lead having an average diameters of less than 27 μm, which are additives. The mixing ratio of graphite powders, copper powders, molybdenum disulfide powders, lead powders are, respectively, 62.5 wt %:35 wt %:1.5 wt %:1.0 wt % by the weight ratio. Herein, it is noted that electrolytic copper powders are superior to other copper powders in respect of the electric conductivity and sliding properties. But, if more than 5 wt % of adhesives is added to graphite, it may cause the specific-resistance of the brush to be increased. Also, during the operation of the motor, the skin film adjustment of the commutator is difficult and causes the brush to have poor electric conductivity.

Thereafter, these mixed powders are press-molded at a pressure of 2.75 ton/cm$^2$, fired at a temperature of 700° C. to carbonize adhesives, while a lead wire is attached thereto. Subsequently, a metal graphite brush is completed through the treatment adaptable to the motor.

Herein, it is noted that if the mixed resin of novolak phenol resin and furfural resin, known as the adhesives, is carbonized, its contraction rate is greater than that of carbonized novolak phenol resin. This reduces the porosity and the specific resistance of the brush, thereby enhancing the power output characteristics of the motor. Because the adhesives are carbonized into hard carbons during firing, the bonding strength between the graphite particles is improved. Adhesives also carry out abrasive function which adjusts the skin film on the surface of the commutator.

Figure 2:
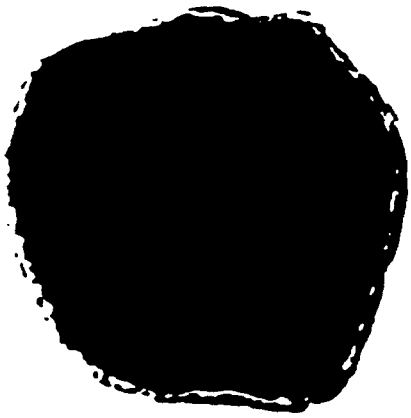

Namely, as illustrated in FIG. 1 and FIG. 2, the wetabilities are represented with respect to the use of only novolak phenol resin and the mixed resin of novolak phenol resin and furfural resin at a ratio of 50:50, which are fired at 700° C. according to the present invention.

However, if a large amount of carbons is contained in the adhesives, it causes the bonding strength to be higher, but the lubrication property becomes worse. It also raises the friction coefficient which results in an increase in the noise of the motor.

Therefore, the mixed resin of novolak phenol resin containing carbons of about 70% and furfural resin containing carbons of about 60% is used to adjust the carbonized amount, thereby reducing the friction coefficient of the brush and improving the noise reduction characteristics.

As described above, if these powders comprising a predetermined compound ratio are uniformly mixed with additives of the mixed resin of novolak phenol resin and furfural resin at a ratio of 50:50, it is changed into hard carbon having a uniform distribution during firing. Therefore, the porosity and the specific resistance of the brush are reduced, so the friction efficient is reduced, thereby the noise reduction characteristics of the motor are enhanced.

On the other hand, the metal graphite brush produced according to the present invention is mounted in a heater blower motor for an automobile, which is of a capacity of 160 W. The motor is rotated when a torque load of 4.7 Kg·cm is applied to the output shaft end thereof in order to measure the output. The noise is tested under the where no load is attached to the motor in the soundproofing chamber, in a manner that the collected noise is analyzed and measured by its frequency.

As a result, the density, porosity, friction efficient, power output and noise of the metal graphite brush made using the mixed resin of novolak phenol resin and furfural resin at a ratio by 50:50 as the adhesives, compared with that made using only novolak phenol resin, is represented in the following table.

| | EMBODIMENT | |
|---|---|---|
| | novolak phenol resin and furfural resin | novolak phenol resin |
| DENSITY (g/cm$^2$) | 2.68 | 2.64 |
| POROSITY (%) | 10.36 | 11.74 |

-continued

| | EMBODIMENT | |
|---|---|---|
| | novolak phenol resin and furfural resin | novolak phenol resin |
| SPECIFIC RESISTANCE (μΩ · cm) | 210 | 280 |
| FRICTION EFFICIENT | 0.23 | 0.28 |
| OUTPUT (%) | 62 | 58 |
| NOISE (dB) | 23.0 | 27.3 |

Therefore, it is noted that, compared to the novolak phenol resin brush, the metal graphite brush comprising the mixed resin of novolak phenol resin and furfural resin increases the density, reduces the porosity and specific resistance to improve the output characteristics, and lowers the friction efficient to enhance the noise reduction characteristics.

What is claimed is:

1. A method for manufacturing a metal graphite brush comprising the steps of:

a. preparing natural graphite powders of 60–70 wt %, electrolytic coppers of 30–40 wt %, molybdenum disulfide and lead of 2.5 wt %, which are additives, and novolak phenol resin and furfural resin of 1–15 wt %, which are adhesives;

b. wet-mixing the mixed resins with the graphite powders and preparing powders having a diameter less than 200 μm;

c. press-molding said powders at the pressure of 2–3 ton/$cm_2$, firing at a temperature of 600°–800° C. and simultaneously attaching a lead wire thereto; and d. the compound ratio of the metal graphite brush being graphite powders of 62.5 wt %, copper powders of 35 wt %, additives of 2.5 wt %, and the mixed resin of said novolak phenol resin and said furfural resin at a ratio of 50:50 being added by a weight ratio of 7.5 wt % to the graphite powders.

2. A method for manufacturing a metal graphite brush comprising the steps of:

a. preparing natural graphite powders of about 60–70 wt %, electrolytic coppers of about 30–40 wt %, additives of about 2.5 wt % compounded of molybdenum disulfide and lead, and adhesives of about 1% to 15% which are the mixed resin of novolak phenol resin and furfural resin at a weight ratio of about 50:50;

b. adding the adhesives to the graphite powders so as to increase the bonding between the particles after firing;

c. wet-mixing the adhesives with the graphite powders and preparing powders having a diameter less than 200 μm; and, d. press-molding said powders at a pressure of 2–3 ton/$cm_2$, firing at a temperature of 600–800 degrees C. and simultaneously attaching a lead wire thereto.

3. The method for manufacturing a metal graphite brush according to any one of claim 2, wherein: the powders for manufacturing the metal graphite brush are graphite powders having a particle size selected from −150 μm to 63 μm corresponding to 30–40 wt %, −63 μm to 45 μm corresponding to 25–35 wt % and −45 μm corresponding to 30–40 wt % and copper powders having an average particle size of 27 μm.

4. The method as recited in claim 2, wherein the mixed resin of the novolak phenol and the furfural resin is added by a weight ratio of about 7.5% of the graphite powders.

5. A method for manufacturing a metal graphite brush comprising the steps of:

a. preparing natural graphite powders of about 60 wt % electrolytic coppers of about 35 wt %, additives of about 2.5 wt % comprising molybdenum disulfide and lead, and adhesives of 1–15 wt % which are a mixed resin of novolak phenol resin and furfural resin at a weight ratio of about 50:50;

b. adding the adhesives to the graphite powders so as to increase the bonding between the particles after firing;

c. wet-mixing the adhesives with the graphite powders and preparing powders having a diameter less than 200 μm; and, d. press-molding said powders at a pressure of 2–3 ton/$cm_2$, firing at a temperature of 600–800° C. and simultaneously attaching a lead wire thereto.

6. The method as recited in claim 5, wherein the powders for manufacturing the metal graphite brush are graphite powders having a particle size selected from −150 μm to 63 μm corresponding to 30–40 wt %, −63 μm to 45 μm corresponding to 25–35 wt % and −45 μm corresponding to 30–40 wt % and copper powders having an average particle size of 27 μm.

7. The method as recited in claim 5, wherein the mixed resin of the novolak phenol and the furfural resin is added by a weight ratio of about 7.5% of the graphite powders.

* * * * *